US011848142B2

(12) United States Patent
Kurahashi et al.

(10) Patent No.: US 11,848,142 B2
(45) Date of Patent: Dec. 19, 2023

(54) MULTILAYER COIL COMPONENT AND METHOD FOR MANUFACTURING SAME, AS WELL AS CIRCUIT BOARD CARRYING MULTILAYER COIL COMPONENT

(71) Applicant: TAIYO YUDEN CO., LTD., Tokyo (JP)

(72) Inventors: Shuhei Kurahashi, Takasaki (JP); Jun Kumagai, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 706 days.

(21) Appl. No.: 16/825,912

(22) Filed: Mar. 20, 2020

(65) Prior Publication Data

US 2020/0312522 A1 Oct. 1, 2020

(30) Foreign Application Priority Data

Mar. 28, 2019 (JP) ..... 2019-062472

(51) Int. Cl.
*H01F 27/28* (2006.01)
*H01F 27/29* (2006.01)
(Continued)

(52) U.S. Cl.
CPC ..... *H01F 27/2804* (2013.01); *H01F 1/33* (2013.01); *H01F 27/292* (2013.01); *H01F 41/043* (2013.01); *H01F 2027/2809* (2013.01)

(58) Field of Classification Search
CPC ... H01F 1/33; H01F 1/342; H01F 1/38; H01F 1/09; H01F 27/2804; H01F 2027/2809;
(Continued)

(56) References Cited

U.S. PATENT DOCUMENTS

2014/0218147 A1* 8/2014 Chatani ..... H01F 1/14766 336/20
2015/0155084 A1* 6/2015 Kim ..... H01F 17/0013 336/200
(Continued)

FOREIGN PATENT DOCUMENTS

JP 2007027354 A 2/2007
JP 2013055315 A 3/2013
(Continued)

OTHER PUBLICATIONS

A Notice of Reasons for Refusal issued by the Japanese Patent Office, dated Feb. 2, 2023, for Japanese counterpart application No. 2019-062472. (5 pages).

*Primary Examiner* — Tszfung J Chan
(74) *Attorney, Agent, or Firm* — Law Office of Katsuhiro Arai

(57) ABSTRACT

Magnetic layers of the multilayer coil component are constituted by: soft magnetic alloy grains 21 containing Fe, Si, and at least one of Cr and Al, as constituent elements; and an oxide layer 22 formed around the soft magnetic alloy grains to bond the soft magnetic alloy grains together, and also containing Si as well as at least one of Cr and Al as constituent elements, where the content of Si based on mass is higher than the total content of Cr and Al. The multilayer coil component can have a small thickness and offer excellent magnetic properties.

5 Claims, 4 Drawing Sheets

(51) Int. Cl.
*H01F 41/04* (2006.01)
*H01F 1/33* (2006.01)

(58) Field of Classification Search
CPC .. H01F 17/0013; H01F 17/0006; H01F 5/003; H01F 27/292
USPC ..... 336/200, 232
See application file for complete search history.

(56) References Cited

U.S. PATENT DOCUMENTS

2016/0254082 A1* 9/2016 Tanada ..... C22C 38/002 420/78
2017/0287605 A1* 10/2017 Tanada ..... H01F 1/28

FOREIGN PATENT DOCUMENTS

JP 2014143286 A 8/2014
JP 2014216495 A * 11/2014
JP 2017073547 A 4/2017
JP 2017076700 A * 4/2017
JP 2017092431 A 5/2017
JP 2019178402 A 10/2019

* cited by examiner

MULTILAYER COIL COMPONENT AND METHOD FOR MANUFACTURING SAME, AS WELL AS CIRCUIT BOARD CARRYING MULTILAYER COIL COMPONENT

CROSS-REFERENCE TO RELATED APPLICATIONS

The present application claims priority to Japanese Patent Application No. 2019-062472, filed Mar. 28, 2019, the disclosure of which is incorporated herein by reference in its entirety including any and all particular combinations of the features disclosed therein.

BACKGROUND

Field of the Invention

The present invention relates to a multilayer coil component and a method for manufacturing the same, as well as a circuit board carrying a multilayer coil component.

Description of the Related Art

In recent years, multi-functionalization of mobile electronic devices, electronification of vehicle controls, and other trends are requiring that the so-called "chip-type" small coil components and inductance components installed in these devices and controls have larger current capacities. For example, multilayer type coil components (multilayer coil components) that permit thickness reduction are facing a strong call for high current flow.

To answer such call for high current flow, studies are being conducted to constitute the magnetic body parts of multilayer coil components using ferrous metal magnetic materials that are more resistant to magnetic saturation under electrical current (have higher saturation magnetic flux densities) compared to conventional ferrite materials.

The magnetic body part of a multilayer coil component is formed by numerous magnetic material grains contacting one another, where the constitution is such that parts of the grains are in contact with internal conductors. Accordingly, when the magnetic material that constitutes the magnetic body part is replaced from a ferrite to a metal, oftentimes an oxide film is formed around the individual magnetic body grains to ensure insulating property, in order to reduce eddy current loss resulting from the fact that the insulating resistance of the metal magnetic material is lower than that of the ferrite material (Patent Literatures 1, 2).

A known method for forming such oxide film (oxide film) is to degrease the laminate body of magnetic layers and conductor patterns, and then heat-treat it for approx. 2 hours at approx. 700° C. in the air or other oxidizing atmosphere (Patent Literature 2).

BACKGROUND ART LITERATURES

[Patent Literature 1] Japanese Patent Laid-open No. 2013-55315

[Patent Literature 2] Japanese Patent Laid-open No. 2017-92431

SUMMARY

However, heat-treating in the air a laminate body that uses an Fe alloy material being a magnetic material with a high Fe ratio may create a situation where, near the surface that contacts the air, oxidation of the metal magnetic material is promoted due to oxygen in the air and a thick oxide film is formed as a result, but in the interior part that never contacts the air, formation of a thick oxide film is prevented due to lack of oxygen, and consequently the oxide film thickness varies within the laminate body. This presents the problem that forming an oxide film to a thickness that ensures the preferred insulating property in the interior part of the laminate body makes the oxide film too thick near the surface, and results in drop in magnetic properties. On the other hand, forming an oxide film to a minimum thickness that ensures the preferred insulating property at the surface of the laminate body results in an insufficient oxide film thickness in the interior part as well as insufficient insulation, particularly between the internal conductors isolated by the magnetic layers. For this reason, the spacing of the internal conductors must be widened, but it causes the component thickness to increase and diminishes the advantage of the multilayer coil component that permits thickness reduction.

Accordingly, an object of the present invention is to solve the aforementioned problems and provide a multilayer coil component offering excellent magnetic properties and having a small thickness.

After conducting various studies to solve the aforementioned problems, the inventor of the present invention found that the problems could be solved by using a specific composition for the magnetic metal grains that constitute the multilayer coil component and also arranging the oxide layer formed on the surface of the magnetic metal grains to have a specific composition—as this ensures that the oxide layer will have excellent insulating property and also reduces the difference in film thickness between the surface and the interior part of the multilayer coil component—and consequently completed the present invention.

To be specific, a first aspect of the present invention to solve the aforementioned problems is a multilayer coil component comprising: multiple magnetic layers stacked in one axis direction; an internal conductor formed through the magnetic layers; and a pair of external electrodes electrically connected to the internal conductor; wherein such multilayer coil component is characterized in that the magnetic layers are constituted by: soft magnetic alloy grains containing Fe, Si, and at least one of Cr and Al, as constituent elements; and an oxide layer formed around the soft magnetic alloy grains to bond the soft magnetic alloy grains together, and also containing Si as well as at least one of Cr and Al as constituent elements, where the content of Si based on mass is higher than the total content of Cr and Al.

Also, a second aspect of the present invention is a method for manufacturing a multilayer coil component that includes: preparing green sheets that contain a soft magnetic alloy powder; forming conductor patterns on the green sheets; laminating, pressure bonding and heat-treating the green sheets on which the conductor patterns have been formed, to obtain a laminate body comprising: an internal conductor formed by the conductor patterns; and magnetic layers which are formed by the grains of the soft magnetic alloy powder in the green sheets, and in which the soft magnetic alloy grains are bonded together via an oxide layer; and forming external electrodes that are electrically continuous with the internal conductor, on the surface of the laminate body; wherein such method for manufacturing a multilayer coil component is characterized in that: the soft magnetic alloy powder in the green sheets contains Fe, Si, and at least one of Cr and Al, as constituent elements, where the content of Si is higher than the total content of Cr and Al; and the heat treatment includes: a first heat treatment for removing the binder in the green sheet and conductor patterns; and a second heat treatment performed after the first heat treatment in an atmosphere of 5 to 800 ppm in oxygen concentration and at a temperature of 500 to 900° C.

Furthermore, a third aspect of the present invention is a circuit board carrying the aforementioned multilayer coil component.

According to the present invention, a multilayer coil component offering excellent magnetic properties and having a small thickness can be provided.

DESCRIPTION OF THE SYMBOLS

Figure 1A:
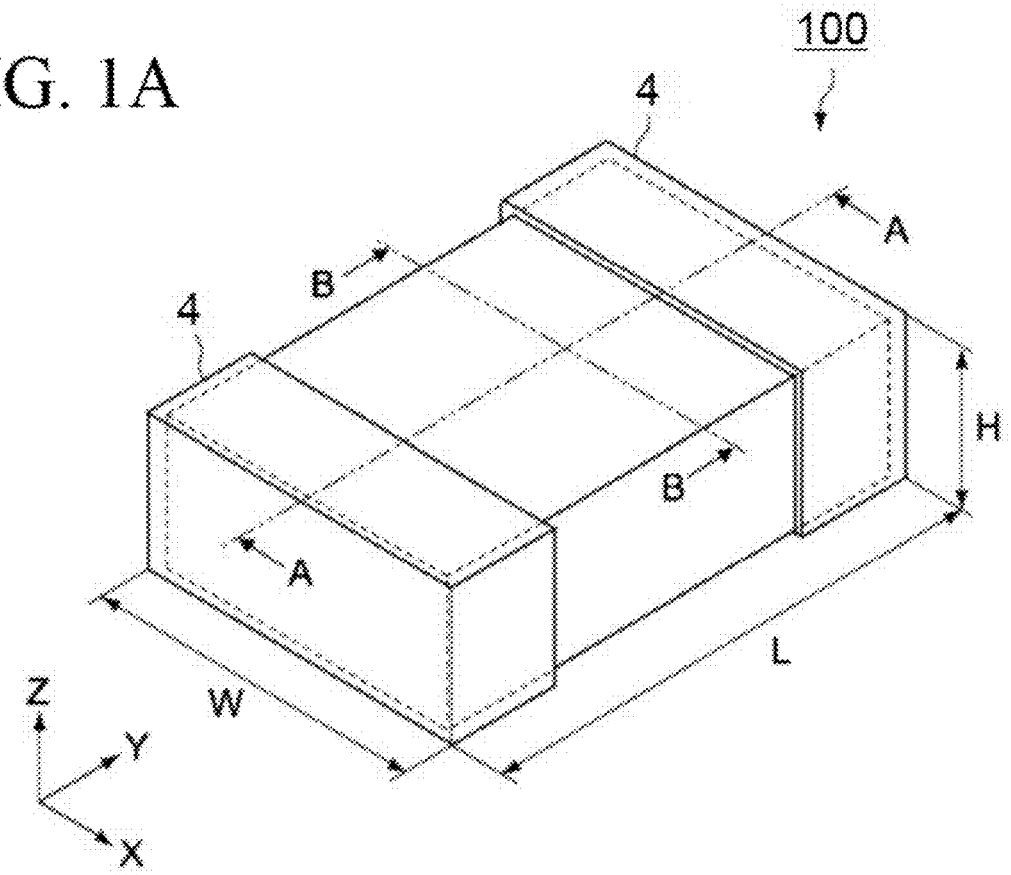
FIGS. 1A and 1B are schematic views showing the overall structure of the multilayer coil component pertaining to the first aspect of the present invention (1A: General perspective view, 1B: View of cross-section B-B in 1A)

100 Multilayer coil component
2 Magnetic layer
21 Soft magnetic alloy grain
22 Oxide layer
221 Si-enriched area
222 Si-rich area
23 Fe-rich layer
3 Internal conductor
31 Conductor pattern
32 Connection conductor
4 External electrode

DETAILED DESCRIPTION OF EMBODIMENTS

The constitutions as well as operations and effects of the present invention are explained below, together with the technical ideas, by referring to the drawings. It should be noted, however, that the mechanisms of operations include estimations and whether they are right or wrong does not limit the present invention in any way. Also, of the components in the aspects below, those components not described in the independent claims representing the most generic concepts are explained as optional components. It should be noted that a description of numerical range (description of two values connected by "to") is interpreted to include the described values as the lower limit and the upper limit.

[Multilayer Coil Component]

The multilayer coil component pertaining to the first aspect of the present invention (hereinafter also referred to simply as "first aspect") is a multilayer coil component comprising: multiple magnetic layers stacked in one axis direction; an internal conductor formed through the magnetic layers; and a pair of external electrodes electrically connected to the internal conductor; wherein the magnetic layers are constituted by: soft magnetic alloy grains containing Fe, Si, and at least one of Cr and Al, as constituent elements; and an oxide layer formed around the soft magnetic alloy grains to bond the soft magnetic alloy grains together, and also containing Si as well as at least one of Cr and Al as constituent elements, where the content of Si based on mass is higher than the total content of Cr and Al.

Figure 1B:
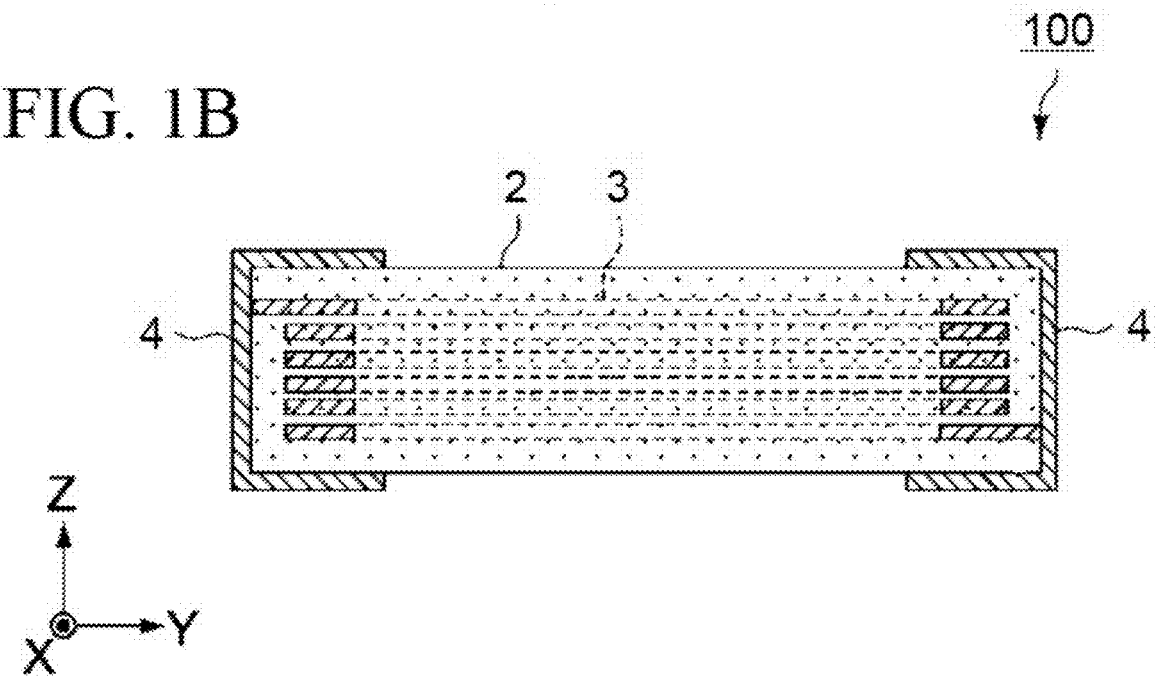
Figure 2:
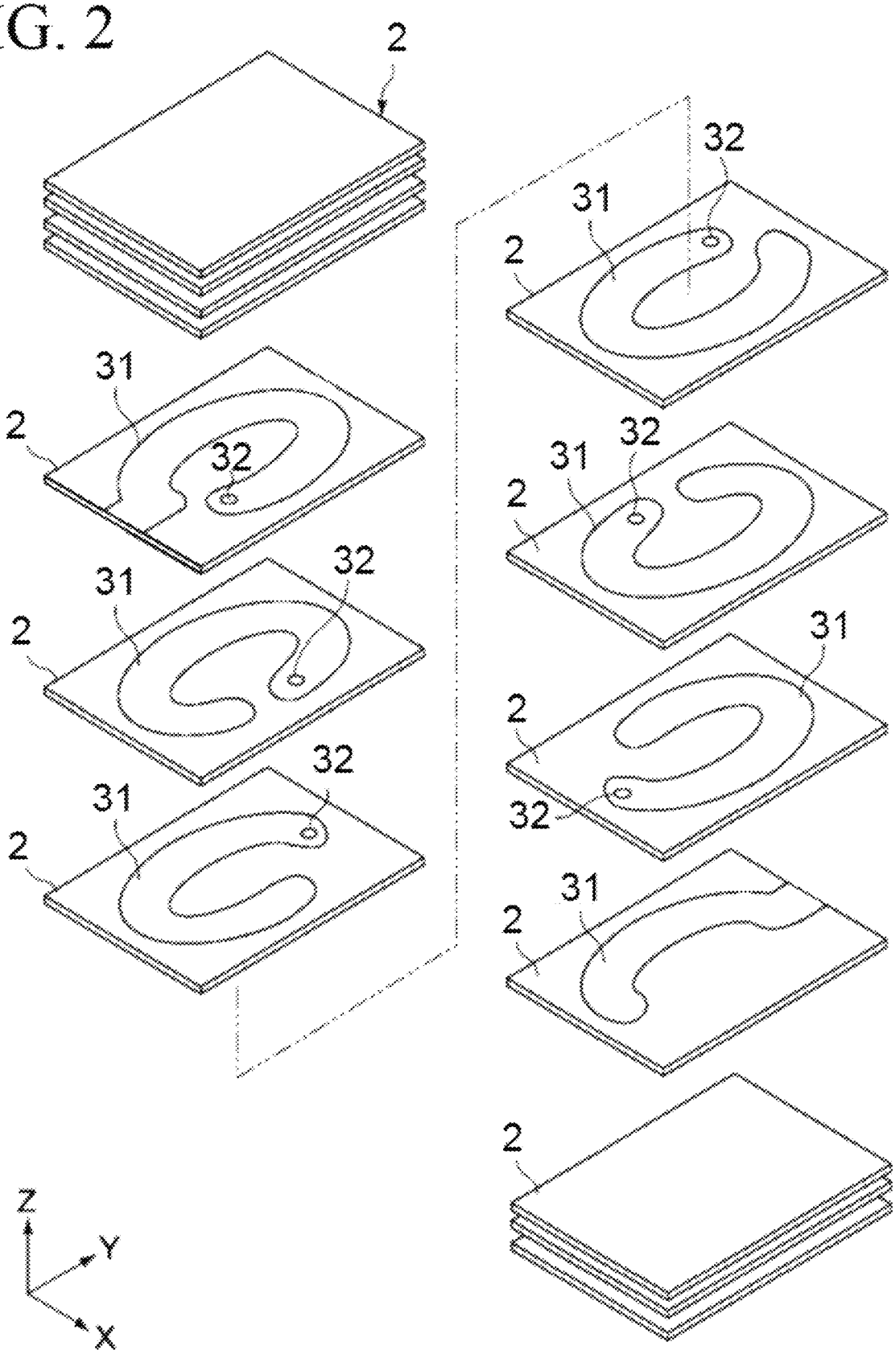
FIG. 2 is a schematic view showing the internal conductor structure of the multilayer coil component pertaining to the first aspect of the present invention

First, the overall structure of the first aspect is explained by referring to FIGS. 1A, 1B, and 2.

The multilayer coil component 100 pertaining to the first aspect comprises, as shown in FIGS. 1A and 1B: multiple magnetic layers 2, 2, . . . stacked in one axis direction; an internal conductor 3 passing between the magnetic layers and also through the magnetic layers, to form a coil which is wound around the one axis; and a pair of external electrodes 4, 4 electrically connected to the internal conductor.

The internal conductor 3 is constituted by, as shown in FIG. 2: conductor patterns 31, 31, . . . that are each formed on each of the magnetic layers 2, 2, . . . and sandwiched between two magnetic layers 2, 2 that are adjacent to each other in the one axis direction (laminating direction); and connection conductors 32, 32, . . . that penetrate through the magnetic layers 2, 2, . . . in the one axis direction to electrically connect the conductor patterns 31, 31, . . . together. The conductor patterns 31, 31, . . . are each formed on each of the magnetic layers 2, 2, . . . roughly in the shape of a circle or semi-circle.

It should be noted that the shape of the multilayer coil component 100 pertaining to the first aspect, including the thickness and laminated number of the magnetic layers 2 constituting the component, shape of the internal conductor 3, etc., is not limited to the one mentioned above and should be set as deemed appropriate according to the required characteristics. For example, the conductor pattern 31 may consist of only one layer, and the internal conductor 3 may have a plane coil shape. Also, the coil component in this Specification encompasses coil components having a meandering, linear or other internal conductor, and the one in the first aspect may also have such shape.

The materials for the internal conductor 3 and external electrodes 4 used in the first aspect are not limited in any way so long as they are highly conductive and also physically and chemically stable in the use environment of the multilayer coil component 100, and, for example, silver, copper, or an alloy thereof, and the like, may be used.

In the first aspect, the magnetic layers 2, 2, . . . are constituted by soft magnetic alloy grains 21 that are bonded together by a highly insulating, thin oxide layer 22, while the difference in oxide layer 22 thickness between the magnetic layer 2 positioned at the surface and the magnetic layer 2 positioned at the center part is also small, as described below; accordingly, good electrical insulating property and magnetic properties can be achieved even when the magnetic layer 2 thickness is reduced and the distance between the internal conductors 3 is narrowed. To be specific, the distance between the internal conductors 3 may be adjusted to 10 μm or less, or to 3 μm or less in a preferred mode, or to 1 μm or less in a more preferred mode.

Figure 3:
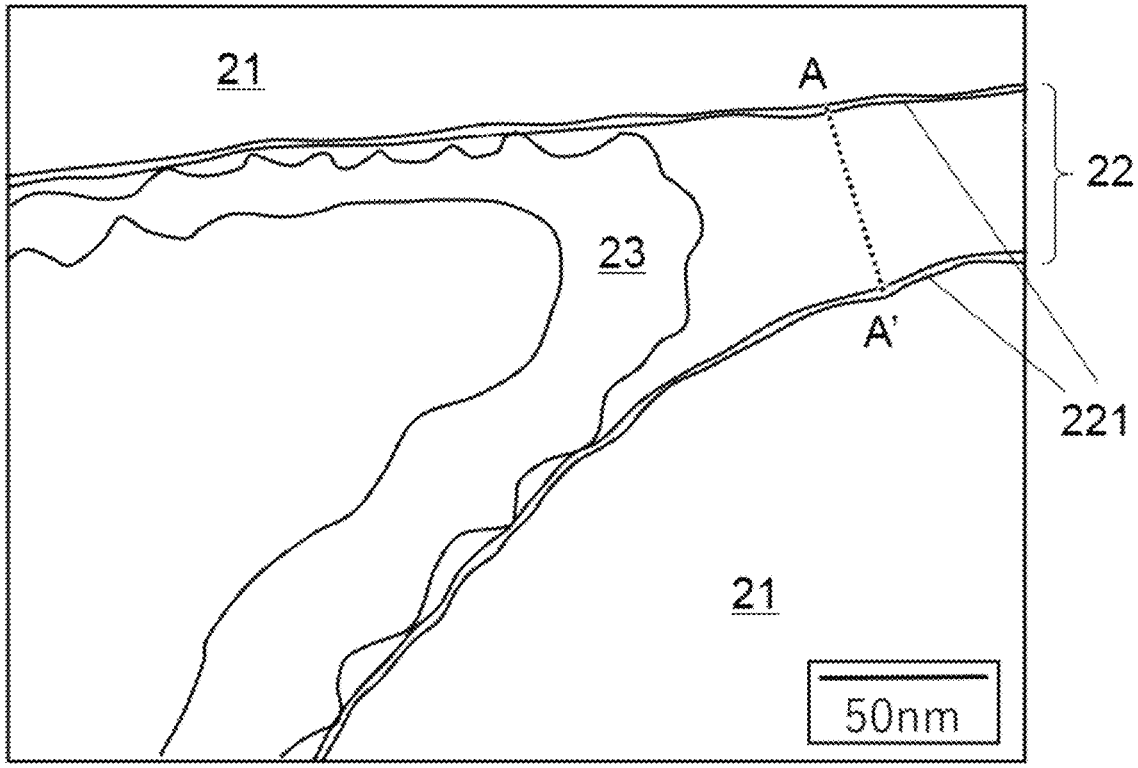
FIG. 3 is a schematic view showing the microstructure of the magnetic layer in the multilayer coil component pertaining to the first aspect of the present invention (Confirmed result of the oxide layer structure, of a test piece pertaining to an example, based on a scanning transmission electron microscope (STEM))

Next, the microstructure of the magnetic layers 2, 2, . . . in the first aspect is explained by referring to FIG. 3.

The magnetic layers 2, 2, . . . contain soft magnetic alloy grains that in turn contain Fe, Si, and at least one of Cr and Al, as constituent elements.

When the soft magnetic alloy grains 21 contain Si, a higher electrical resistance will allow for inhibition of any drop in magnetic properties due to eddy current. Preferably Si is present more abundantly on the surface side, than in the interior part, of the soft magnetic alloy grain 21. To be specific, this means that the maximum value of Si quantity in a range of 0 to 50 nm in distance from the surface of the metal part, toward the interior side, of the soft magnetic alloy grain 21 is greater than the maximum value of Si quantity in a range of 100 to 150 nm in distance from the surface of the metal part, toward the interior side, of the soft magnetic alloy grain 21. Also, when the soft magnetic alloy grains 21 contain at least one of Cr and Al, excellent oxidation resistance will be achieved. Preferably Cr and Al in the soft magnetic alloy grain 21 are present more abundantly on the surface side, than in the internal part, of the grain.

The composition of the soft magnetic alloy grain 21 is not limited in any way so long as the aforementioned requirements are satisfied, and it may be, for example, one where Si is contained by 1 to 10 percent by mass, Cr, if contained, is contained by 0.5 to 5 percent by mass, Al, if contained, is contained by 0.2 to 3 percent by mass, and Fe and unavoidable impurities (including, e.g., oxygen, hydrogen, nitrogen and unavoidable metal element impurities) account for the remainder. To inhibit segregation of Cr and Al in the alloy part to achieve particularly excellent magnetic properties, the total quantity of Cr and Al is preferably 4 percent by mass or less, or more preferably 2 percent by mass or less. Furthermore, if the alloy part contains Al, it is particularly preferable that its content is 1 percent by mass or less, because Al oxidizes more easily than does Cr at the grain surface.

It should be noted that, needless to say, the alloy part may contain elements other than those mentioned above.

In the magnetic layers 2, 2, . . . , the soft magnetic alloy grains 21 are bonded together via the oxide layer 22 formed around the grains 21. Also, the oxide layer 22 contains Si as well as at least one of Cr and Al as constituent elements, where the content of Si based on mass is higher than the total content of Cr and Al.

When the oxide layer 22 contains Si as well as at least one of Cr and Al, a reduced migration rate of oxygen in the layers will inhibit the oxide layer 22 from increasing in thickness as a result of oxygen reaching the soft magnetic alloy grain 21 near the surface of the multilayer coil component 100 and Fe oxidizing as a result.

Also, when the content of Si based on mass is higher than the total content of Cr and Al in the oxide layer 22, excellent electrical insulating property can be achieved. Additionally, the fact that the content of Cr and Al is lower than that of Si in the oxide layer 22 is preferable in that it means that an oxide layer 22 of reduced thickness has been obtained as a result of inhibited diffusion of Cr and Al, which diffuse more easily to the oxide layer 22 than does Si during heat treatment in the presence of oxygen when the multilayer coil component 100 was manufactured, thus reducing the diffusion fluxes from the soft magnetic alloy grain 21 to the oxide layer 22.

As described above, in the first aspect the soft magnetic alloy grains 21 are isolated from one another in the magnetic layers 2, by the oxide layer 22 having a low oxygen migration rate and excellent insulating property; as a result, the magnetic layers 2 will have a small difference in oxide layer 22 thickness between the surface and the interior part of the multilayer coil component 100, as well as excellent insulating property, and consequently the magnetic layer 2 thickness will be kept small and a thin multilayer coil component 100 will be obtained.

Preferably the oxide layer 22 has a Si-enriched area 221 that contains Si by at least three times as much as the element—among Fe, Cr, and Al—whose content is the second highest to Si based on mass, and adjoins the soft magnetic alloy grain 21 at the Si-enriched area 221. When the oxide layer 22 has such structure, superior electrical insulating property will be achieved. More preferably the Si-enriched area 221 has locations where the content of Si based on mass is at least five times that of the element contained in the second largest quantity to Si, and yet more preferably it has locations where the multiple is at least 10 times.

Figure 4:
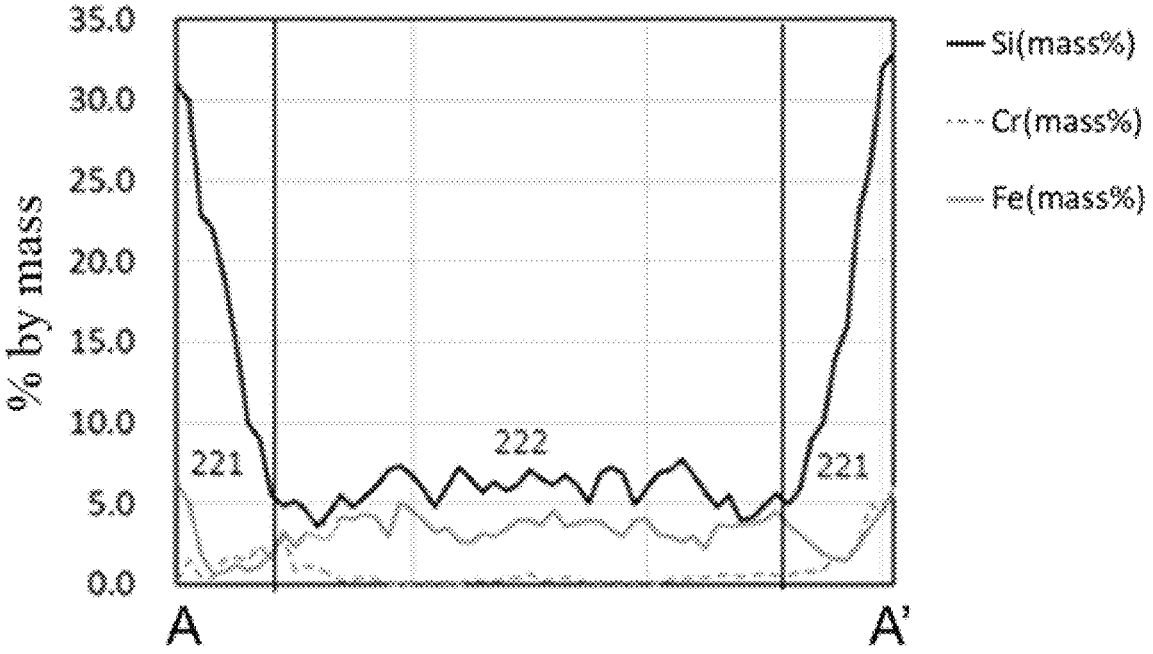
FIG. 4 is results of line analysis along A-A' in FIG. 3

Furthermore, the oxide layer 22 is such that, as shown in FIG. 4, the content of Si is lower in a Si-rich area 222 that appears near its center part, than in the Si-enriched area 221. The content of Si in the Si-enriched area 221 is preferably at least 1.5 times, or more preferably at least twice, or yet more preferably at least three times, the content of Si in the Si-rich area 222. When the oxide layer 22 has such structure, superior electrical insulating property will be achieved and the film thickness can also be reduced.

In addition, preferably the oxide layer 22 contains Si in the largest quantity based on mass over its entirety, as shown in FIG. 4. When the oxide layer 22 has such structure, superior electrical insulating property will be achieved and the film thickness can also be reduced.

Here, the composition of the soft magnetic alloy grain 21 and structure of the oxide layer 22, in the magnetic layer 2, are confirmed according the procedures below.

First, a thin sample of 50 to 100 nm in thickness is taken from the center part of the multilayer coil component 100 using a focused ion beam (FIB) device, and immediately thereafter a composition mapping image near the oxide layer 22 is captured per the STEM-EDS method using a scanning transmission electron microscope (STEM) equipped with an annular dark-field detector and an energy-dispersive X-ray spectroscopy (EDS) detector. As for the STEM-EDS measurement conditions, the acceleration voltage is set to 200 kV and the electron beam diameter, to 1.0 nm, with the measurement time set in such a way that the integral count of signal strengths that fall in the range of 6.22 to 6.58 keV at each point in the soft magnetic alloy grain 21 becomes 25 or greater. Then, the area where the ratio of the signal strength of the OKα ray ($I_{OK\alpha}$) to the total sum of the signal strength of the FeKα ray ($I_{FeK\alpha}$), signal strength of the CrKα ray ($I_{CrK\alpha}$) and signal strength of the AlKα ray ($I_{AlK\alpha}$), or ($I_{OK\alpha}/(I_{FeK\alpha}+I_{CrK\alpha}+I_{AlK\alpha})$), is 0.5 or greater is recognized as the oxide layer 22, while the area where this value is less than 0.5 is recognized as the soft magnetic alloy grain 21.

The composition of the soft magnetic alloy grain 21 is determined by conducting line analysis of the area that has been determined as the soft magnetic alloy grain 21 based on the aforementioned signal strength ratio, in the diameter direction from the oxide layer 22 side according to the STEM-EDS method, to measure the distributions of Fe, Si, Cr, and Al, and then calculating the average value of content of each element for the first three measuring points where the content of each such element varies by no more than ±1 percent by mass. It should be noted that, if the composition of the soft magnetic alloy powder used in the manufacture of the multilayer coil component 100 is known, the known composition may be used as the composition of the soft magnetic alloy grain 21.

The structure of the oxide layer 22 is confirmed by conducting line analysis according to the STEM-EDS method along a line segment—in an arbitrary part of the area that has been determined as the oxide layer 22 based on the aforementioned signal strength ratio, where soft magnetic alloy grains 21 are bonded together—continuing from one soft magnetic alloy grain 21 to the other soft magnetic alloy grain 21 via the oxide layer 22, and then measuring the distribution of each element.

In the first aspect, preferably the ratio of the oxide layer 22 thickness in the magnetic layer 2 positioned at the center part in the laminating direction ($t_{center}$), to the oxide layer 22 thickness in the magnetic layer 2 positioned at the topmost surface in the laminating direction ($t_{surface}$), or ($t_{center}/t_{surface}$), is adjusted to 0.80 or higher. When the oxide layer 22 thickness ratio is adjusted to this range, the internal conductors can be electrically insulated from each other without making the oxide layer 22 at the topmost surface excessively thick. Because of this, the oxide layer 22 thickness can be made thin and uniform throughout the magnetic layers, and the magnetic permeability can be increased as a result. The ratio ($t_{center}/t_{surface}$) is adjusted more preferably to 0.85 or higher, or yet more preferably to 0.90 or higher.

Here, the oxide layer 22 thickness in the magnetic layer 2 positioned at the topmost surface, and that in the magnetic layer 2 positioned at the center part, in the laminating direction, are determined as follows.

The topmost surface of the multilayer coil component 100 in the laminating direction is observed using a scanning electron microscope (SEM) (S-4300, manufactured by Hitachi High-Technologies Corporation), and by focusing on the oxide layer 22 that forms bonded parts between soft magnetic alloy grains 21 as recognized by contrast differences, its thickness (intergranular distance) is measured at 20 locations at a magnification of 20,000 to 50,000 times to calculate the average, and one-half this average is used as the oxide layer 22 thickness in the magnetic layer 2 positioned at the topmost surface in the laminating direction ($t_{surface}$). Also, the multilayer coil component 100 is cut through a plane parallel with the laminating direction, and the magnetic layer 2 positioned at the center part of the cut plane in the laminating direction is observed with an SEM, and then the oxide layer 22 thickness in the magnetic layer positioned at the center part ($t_{center}$) is determined using the same method.

Also, in the first aspect, preferably an Fe-rich layer 23 that contains Fe—among Fe, Si, Cr, and Al—in the largest quantity based on mass is further provided on the side of the oxide layer 22 not contacting the soft magnetic alloy grain 21. When an Fe-rich layer 23 is provided on the outer side of the oxide layer 22, voids in the magnetic layers 2 will decrease and the strength of the multilayer coil component 100 will improve as a result.

[Method for Manufacturing Multilayer Coil Component]

The method for manufacturing a multilayer coil component pertaining to the second aspect of the present invention (hereinafter also referred to simply as "second aspect") includes: preparing green sheets that contain a soft magnetic alloy powder; forming conductor patterns on the green sheets; laminating, pressure bonding, and heat-treating the green sheets on which the conductor patterns have been formed, to obtain a laminate body comprising: an internal conductor formed by the conductor patterns; and magnetic layers which are formed by the grains of the soft magnetic alloy powder in the green sheets, and in which the soft magnetic alloy grains are bonded together via an oxide layer; and forming external electrodes that are electrically continuous with the internal conductor, on the surface of the laminate body. Also, the soft magnetic alloy powder in the green sheets contains Fe, Si, and at least one of Cr and Al, as constituent elements, where the content of Si is higher than the total content of Cr and Al. Also, the heat treatment includes: a first heat treatment for removing the binder in the green sheet and conductor patterns; and a second heat treatment performed after the first heat treatment in an atmosphere of 5 to 800 ppm in oxygen concentration and at a temperature of 500 to 900° C.

The green sheets in the second aspect are typically manufactured by applying a slurry containing a soft magnetic alloy powder and a binder, on a plastic film or other base film, using a doctor blade, die-coater, or other coating machine, and then drying the slurry.

The binder used is not limited in any way so long as it can form the soft magnetic alloy powder in a sheet shape and retain the shape, and can be removed by heating without allowing any carbon content, etc., to remain. Examples include polyvinyl butyral and other polyvinyl acetal resins.

The solvent for preparing the slurry is not limited in any way, either, and butyl carbitol or other glycol ether may be used.

The content of each component in the slurry should be adjusted as deemed appropriate according to the method adopted for forming green sheets, thickness of the green sheets to be prepared, and so on.

The soft magnetic alloy powder contained in the green sheets contains Fe, Si, and at least one of Cr and Al, as constituent elements, where the content of Si is higher than the total content of Cr and Al.

When the soft magnetic alloy powder contains at least one of Cr and Al, the oxide layer will be inhibited from becoming excessively thick in the heat treatment mentioned below. As a result, the thickness of the oxide layer can be stabilized.

Also, when the soft magnetic alloy powder contains more Si than Cr and Al in total, oxidation of Cr and Al will be prevented during the heat treatment mentioned below, and consequently increase in the thickness of the oxide layer can be prevented. Additionally, in the oxide layer formed by the heat treatment, the mass percentage of Si will be higher than that of Cr and Al in total, which can ensure insulation even when the oxide layer is thin.

The composition of the soft magnetic alloy powder used is not limited in any way so long as the aforementioned requirements are satisfied, and it may be, for example, one where Si is contained by 1 to 10 percent by mass, Cr, if contained, is contained by 0.5 to 5 percent by mass, Al, if contained, is contained by 0.2 to 3 percent by mass, and Fe and unavoidable impurities (including, e.g., oxygen, hydrogen, nitrogen and unavoidable metal element impurities) account for the remainder. So that the content of Si will become higher in mass percentage than the total content of Cr and Al in the oxide layer formed by the heat treatment, more preferably the total quantity of Cr and Al is adjusted to 4 percent by mass or less. Additionally, to achieve particularly excellent magnetic properties by inhibiting the reaction of Cr or Al with oxygen relative to the reaction of Si with oxygen during the heat treatment, preferably the total quantity of Cr and Al is adjusted to 2 percent by mass or less. Furthermore, if the soft magnetic alloy powder contains Al, it is particularly preferable that its content is adjusted to 1 percent by mass or lower, because Al diffuses more easily to the grain surface than does Cr.

It should be noted that, needless to say, the soft magnetic alloy powder may contain elements other than those mentioned above.

The grain size of the soft magnetic alloy powder used is not limited in any way, either, and the average grain size calculated from the granularity distribution measured on volume basis (median diameter ($D_{50}$)) may be adjusted to 0.5 to 30 μm, for example. Preferably the average grain size is adjusted to 1 to 10 μm. This average grain size can be measured using, for example, a granularity distribution measuring device that utilizes the laser diffraction/scattering method.

In the second aspect, the soft magnetic alloy powder, before a slurry for forming green sheets is prepared from the powder, may be heat-treated at a temperature of 600° C. or above in an atmosphere of 5 to 500 ppm in oxygen concentration. As a result of this heat treatment, a smooth oxide film with fewer concavities and convexities will be formed on the surfaces of the grains constituting the soft magnetic alloy powder, resulting in improved compactibility and a higher filling rate. Also, magnetic layers with excellent electrical insulating property can be obtained.

Although the upper limit of the heat treatment temperature is not limited in any way, it is set preferably to 900° C. or below, or more preferably to 850° C. or below, or yet more preferably to 800° C. or below, from the viewpoint of inhibiting oxidation of Fe as well as excessive oxidation of Cr and Al.

Preferably the oxide film is such that its ratio of the mass of Si to the total mass of Cr and Al (Si/(Cr+Al)) at the topmost surface is 1 to 10. When the ratio is 1 or higher, the film will have a smoother surface with even fewer minute concavities and convexities. When the ratio is 10 or lower, on the other hand, excessive oxidation is inhibited and, even if the oxide film is thin, the stability of the film will improve further. The ratio is preferably 8 or lower, or more preferably 6 or lower.

Here, the ratio of the mass of Si to the total mass of Cr and Al (Si/(Cr+Al)) at the topmost surface of the oxide film is measured by the following method. Using an X-ray photoelectron spectrometer (PHI Quantera II, manufactured by ULVAC-PHI, Inc.), the content percentages (percent by atom) of iron (Fe), silicon (Si), oxygen (O), chromium (Cr), and aluminum (Al) are measured at the surface of the soft magnetic alloy grain on which the oxide film has been formed. As for the measuring conditions, the monochromatized AlKα ray is used as an X-ray source, and the detection area is set to 100 μmϕ. Then, from the obtained results, the percentage by mass (percent by mass) of each element is calculated, and based on the results thereof, the ratio of the mass of Si to the total mass of Cr and Al is calculated.

Preferably the aforementioned heat treatment prior to preparation of slurry is performed in such a way that the mass percentage of Si at the topmost surface of the oxide film will become at least five times that in the soft magnetic alloy part positioned inside the grain, and that the mass percentage of Cr or Al at the topmost surface of the oxide film will become at least three times that in the soft magnetic alloy part. By adjusting the mass percentages this way, superior flowability can be achieved.

Also, preferably the aforementioned heat treatment prior to preparation of slurry is performed in such a way that, when the concentrations of Si, Cr, and Al at the topmost surface of each grain constituting the soft magnetic alloy powder before heat treatment, indicated in percent by mass, are given by $[Si_{before\ treatment}]$, $[Cr_{before\ treatment}]$, and $[Al_{before\ treatment}]$, respectively, while the concentrations of Si, Cr, and Al at the topmost surface of each grain constituting the soft magnetic alloy powder after heat treatment, indicated in percent by mass, are given by $[Si_{after\ treatment}]$, $[Cr_{after\ treatment}]$, and $[Al_{after\ treatment}]$, respectively, then $\{([Cr_{after\ treatment}]+[Al_{after\ treatment}])/([Cr_{before\ treatment}]+[Al_{before\ treatment}])\}>([Si_{after\ treatment}]/[Si_{before\ treatment}])$ is satisfied, or specifically, the percentage of increase in the total quantity of Cr and Al at the topmost surface of the grain due to heat treatment becomes greater than the percentage of such increase in the quantity of Si. By performing the heat treatment this way, a soft magnetic alloy powder having a more stable oxide film can be obtained.

Here, it should be noted that the values of $[Si_{after\ treatment}]$, $[Cr_{after\ treatment}]$, and $[Al_{after\ treatment}]$ above represent the results obtained by analyzing the topmost surface of the oxide film, using the aforementioned X-ray photoelectron spectrometer, with respect to the soft magnetic alloy powder that has been heat-treated prior to preparation of slurry, while the values of $[Si_{before\ treatment}]$, $[Cr_{before\ treatment}]$, and $[Al_{before\ treatment}]$ above represent the values obtained from such analysis by changing the measurement sample to the grain constituting the soft magnetic alloy powder before heat treatment.

Also, preferably the aforementioned heat treatment prior to preparation of slurry is performed in such a way that the relationship of the specific surface area S ($m^2/g$) and average grain size $D_{50}$ (μm) of the soft magnetic alloy powder will satisfy Formula (1) below.

[Math. 1]

$$\log S \leq -0.98 \log D_{50} + 0.34 \quad (1)$$

This formula is derived based on the empirical rule that the common logarithm of specific surface area S ($m^2/g$), and the common logarithm of average grain size $D_{50}$ (μm), have a linear relationship. Since the value of specific surface area of a powder is affected not only by the surface concavities and convexities of the grains constituting the powder, but also by the sizes of the grains, it cannot be asserted that a powder with a smaller value of specific surface area is constituted by smooth grains having fewer surface concavities and convexities. Accordingly, in the second aspect, the impact of the surface condition of the grain, and the impact of the grain size, on the specific surface area, are isolated according to the Formula (1) above, and a soft magnetic alloy powder having a smaller specific surface area due to the former impact is considered to have a smooth surface with fewer concavities and convexities. When the relationship of S and $D_{50}$ satisfies Formula (1) above, the powder will have excellent flowability.

The specific surface area S ($m^2/g$) can be decreased further by increasing the percentage of Si present in the oxide film on the grain surface or reducing the surface concavities and convexities of the oxide film. According to an oxide film having fewer surface concavities and convexities, insulation can be maintained with a smaller film thickness, which is preferred. The percentage of Si present in the oxide film on the grain surface can be increased by raising the composition ratio of Si in the soft magnetic alloy powder or lowering the heat treatment temperature. To be specific, the relationship between the specific surface area S ($m^2/g$) and the average grain size $D_{50}$ (μm) more preferably satisfies Formula (2) below, or yet more preferably satisfies Formula (3) below.

[Math. 2]

$$\log S \leq -0.98 \log D_{50} + 0.30 \quad (2)$$

[Math. 3]

$$\log S \leq -0.98 \log D_{50} + 0.25 \quad (3)$$

Here, the specific surface area S is measured/calculated with a fully-automated specific surface area measuring device (Macsorb, manufactured by MOUNTECH Co., Ltd.) using the nitrogen gas adsorption method. First, the measurement sample is deaerated in a heater, after which nitrogen gas is adsorbed and desorbed onto/from the measurement sample, to measure the adsorbed nitrogen quantity. Next, the monomolecular layer adsorption quantity is calculated from the obtained adsorbed nitrogen quantity using the BET 1-point method, and from this value, the surface area of the sample is derived using the area occupied by one nitrogen molecule and the value of Avogadro's number. Lastly, the obtained surface area of the sample is divided by the mass of the sample, to obtain the specific surface area S of the powder.

Also, the average grain size $D_{50}$ is measured/calculated with a granularity distribution measuring device (LA-950, manufactured by Horiba, Ltd.) that utilizes the laser diffraction/scattering method. First, water is put in a wet flow cell as a dispersion medium, and the powder that has been fully crushed beforehand is introduced to the cell at a concentration that allows appropriate detection signals to be obtained, in order to measure the granularity distribution. Next, the median diameter is calculated from the obtained granularity distribution, and this value is defined as the average grain size $D_{50}$.

Furthermore, preferably the aforementioned heat treatment prior to preparation of slurry is performed in such a way that the thickness of the oxide film to be formed thereby will become 10 to 50 nm. When the thickness of the oxide film is adjusted to 10 nm or more, a smooth surface covering the minute concavities and convexities of the alloy part can be formed. Also, high insulating property can be achieved. More preferably the thickness of the oxide film is adjusted to 20 nm or more. This way, the ratio of Si at the oxide film surface can be increased. Also, insulating property can be maintained even when defects occur in the oxide film due to the pressure from the press when the green sheets are pressure bonded together. When the thickness of the oxide film is adjusted to 50 nm or less, on the other hand, drop in the smoothness of the grain surface due to uneven film thickness can be inhibited. Also, high magnetic permeability can be achieved once the multilayer coil component has been formed. More preferably the thickness of the oxide film is adjusted to 40 nm or less.

Here, the thickness of the oxide film is calculated by observing a cross section of magnetic grains constituting the soft magnetic alloy powder using a scanning transmission electron microscope (STEM) (JEM-2100F, manufactured by JEOL Ltd.), measuring the thickness of the oxide film as recognized by a contrast (brightness) difference (attributed to different compositions) from the alloy part inside the grain, at 10 locations on different grains at a magnification of 500,000 times, and then averaging the results.

In the second aspect, through holes may be formed, before the below-mentioned conductor patterns are formed on the green sheets that have been prepared according to the aforementioned method, for embedding the connection conductors that connect the conductor patterns together.

For the forming of through holes, a stamping machine, laser processing machine, or other perforating machine may be used. The arrangement and sizes of through holes to be formed are determined according to the internal conductor shape of the multilayer coil component to be manufactured.

In the second aspect, conductor patterns are formed on the prepared green sheets.

Conductor patterns may be formed by, for example, printing a conductor paste on the surfaces of the green sheets using a screen printer, gravure printer, or other printing machine, and then drying the paste using a hot-air dryer or other drying machine. If through holes are formed in the green sheets before conductor patterns are formed, the conductor paste, when printed, will also fill the through holes that will then constitute the shape of the internal conductor together with the conductor patterns printed on the surfaces of the green sheets.

The conductor paste used for printing may be one containing a conductor powder and an organic vehicle. For the conductor powder, a powder of silver, copper, or alloy thereof, etc., is used. The grain size of the conductor powder is not limited in any way, but one whose average grain size (median diameter ($D_{50}$)) calculated from the granularity distribution measured on volume basis is 1 to 10 μm, is used, for example. The composition of the organic vehicle should be determined by considering compatibility with the binder contained in the green sheets. An example is one prepared by dissolving or swelling polyvinyl butyral (PVB) or other polyvinyl acetal resin in a butyl carbitol or other glycol ether-based solvent. The blending ratio of the conductor powder and organic vehicle in the conductor paste may be adjusted as deemed appropriate according to a paste viscosity suitable for the printing machine used, the film thickness of the conductor patterns to be formed, and so on.

Next, the green sheets on which the conductor patterns have been formed are stacked in a prescribed order and pressure bonded.

When the green sheets are stacked, they may be transferred using a pickup transfer machine, etc. Also, when pressure bonding the stacked green sheets, the thermocompression bonding method using a press machine may be adopted.

If multiple multilayer coil components are to be obtained from the pressure bonded laminate body, the laminate body may be cut to the sizes of individual multilayer coil components using a dicing machine, laser cutting machine, or other cutting machine.

Next, the obtained laminate body is heat-treated. As the heat treatment, a first heat treatment for removing the binder in the green sheets and conductor patterns, as well as a second heat treatment for sintering the conductor powder in the conductor patterns to form an internal conductor while also bonding the grains of the soft magnetic alloy powder in the green sheets together via an oxide film to form magnetic layers, are performed.

The first heat treatment should be performed in the air, superheated steam, or other oxidizing atmosphere, at a temperature and for a period that will eliminate the binder. Examples of heat treatment conditions include 30 minutes to 2 hours at 200 to 300° C. in superheated steam.

The second heat treatment is performed in a low-oxygen atmosphere of 5 to 800 ppm in oxygen concentration.

By keeping the oxygen concentration in the heat treatment atmosphere in the aforementioned range, a Si-rich oxide layer, which contains Si as well as at least one of Cr and Al, can be formed to an appropriate and uniform thickness on the surfaces of the soft magnetic alloy grains. The oxygen concentration is adjusted preferably to 100 ppm or above, or more preferably to 200 ppm or above.

If the oxygen concentration in the heat treatment atmosphere is too low, a short period of heat treatment will result in insufficient formation of oxide layer and consequent lowering of insulating property, while a long period of heat treatment will make the oxide layer too thick due to diffusion of Fe, Cr, or Al into the oxide layer, and the magnetic permeability will drop as a result. If the oxygen concentration in the heat treatment atmosphere is too high, on the other hand, the difference in oxide layer thickness between the surface and the interior part of the multilayer coil component will become too large, while the content of Fe, Cr, or Al in the oxide layer will increase too much, thereby causing the insulating property of the oxide layer to drop.

Also, the second heat treatment is performed at a temperature of 500° C. to 900° C.

By keeping the heat treatment temperature in the aforementioned range, a Si-rich oxide layer, which contains Si as well as at least one of Cr and Al, can be formed to an appropriate and uniform thickness on the surfaces of the soft magnetic alloy grains. The heat treatment temperature is set preferably to 550° C. or above, or more preferably to 600° C. or above. Also, the heat treatment temperature is set preferably to 850° C. or below, or more preferably to 800° C. or below.

The heat treatment period in the second heat treatment is not limited in any way, so long as a Si-rich oxide layer containing Si, as well as at least one of Cr and Al, is formed on the surfaces of the soft magnetic alloy grains, and the soft magnetic alloy grains can be bonded together via the oxide layer; however, it is set preferably to 30 minutes or longer, or more preferably to 1 hour or longer, from the viewpoint of ensuring that the oxide layer will have a sufficient thickness. From the viewpoint of completing the heat treatment quickly and thereby improving the productivity, on the other hand, the heat treatment period is set preferably to 5 hours or shorter, or more preferably to 3 hours or shorter.

The second heat treatment may be a batch process or flow process. Examples of a flow process include a method whereby multiple heat-resistant trays, each carrying the aforementioned laminate body, are introduced into a tunnel furnace either intermittently or successively, to have them pass through an area, which is kept at a prescribed atmosphere and a prescribed temperature, over a prescribed period of time.

In the second aspect, the aforementioned heat treatment may further include, after the second heat treatment, a third heat treatment performed in an atmosphere of 5 to 800 ppm in oxygen concentration and at a temperature of 500° C. to 600° C. which is also lower than the second heat treatment temperature. By performing the third heat treatment, an Fe-rich layer can be formed thickly which contains Fe—among Fe, Si, Cr, and Al—in the largest quantity based on mass on the side of the oxide layer not contacting the soft magnetic alloy grain. This will reduce the voids in the magnetic layers and improve the strength of the multilayer coil component.

If the third heat treatment is performed, preferably it is performed using the same device described for the second heat treatment and also successively following the second heat treatment, from the viewpoint of manufacturing efficiency.

In the second aspect, external electrodes that are electrically continuous with the internal conductor, are formed on the surface of the heat-treated laminate body.

When forming external electrodes, a method whereby a conductor paste prepared beforehand is applied on the surface of the laminate body using a dip coater, roller coater, or other coating machine, and then baked using a sintering furnace or other heating device, may be adopted. For the conductor paste, the aforementioned paste for forming conductor patterns, or the like, may be used as deemed appropriate.

[Circuit Board]

The circuit board pertaining to the third aspect of the present invention (hereinafter also referred to simply as "third aspect") is a circuit board carrying the multilayer coil component pertaining to the first aspect.

The circuit board is not limited in structure, etc., and anything that fits the purpose may be adopted.

The third aspect permits performance enhancement and size reduction, especially lowering of height, by using the coil component pertaining to the first aspect.

Example

The present invention is explained more specifically below using an example; it should be noted, however, that the present invention is not limited to this example.

Example

In this example and the comparative example described below, magnetic bodies having preferred structures and element distributions were obtained through heat treatment in a low-oxygen atmosphere, and the magnetic bodies were confirmed as having a smaller difference in oxide layer thickness between their surface and interior part, using test pieces.

(Preparation of Cubic Test Piece)

First, a soft magnetic alloy powder having a composition of Fe-3.5Si-1.5Cr (the numerical values indicate percent by mass) and an average grain size of 4.0 μm was prepared. Next, this soft magnetic alloy powder was mixed under agitation with an acrylic binder of 1.2 percent by mass, to prepare a compacting material. Next, this compacting material was introduced into a die having a compacting space of quadrangular prism shape, and then uniaxially press-formed at a tonnage of 8 t/cm$^2$, to obtain a cube-shaped compact of 10 mm per side. Next, the obtained compact was placed for 1 hour in a thermostatic chamber kept at 150° C. to cure the binder, and then heated to 300° C. in a superheated steam furnace to perform the first heat treatment and remove the binder by means of pyrolysis. Lastly, using a quartz furnace, the compact was given the second heat treatment under the conditions of 800° C. for 1 hour in an atmosphere of 800 ppm in oxygen concentration, to obtain a cube-shaped test piece.

(Confirmation of Oxide Layer Structure)

The obtained test piece was confirmed, according to the method described above, for the structure of the oxide layer bonding the soft magnetic alloy grains together. A schematic view of the STEM-observed structure of the oxide layer is shown in FIG. 3, while the results of line analysis along line segment A-A' in FIG. 3 are shown in FIG. 4.

According to FIG. 4, clearly the oxide layer 22 contains Si, as well as Fe and Cr. Also, the content of Si is higher than the content of Cr over nearly the entire width of the oxide layer 22, which makes it clear that, in the oxide layer 22, the content of Si based on mass is higher than the total content of Cr and Al. Furthermore, in the oxide layer 22, a Si-enriched area 221 of particularly high Si content was found at the boundary part with the soft magnetic alloy grain 21. In this area, there were locations where the content of Si was approximately five times that of Fe contained in the second largest quantity.

Also, in FIG. 3, presence of an Fe-rich layer 23 of particularly high Fe content was also found on the side of the oxide layer 22 not contacting the soft magnetic alloy grain 21.

(Measurement of Oxide Layer Thickness)

When, with respect to the obtained test piece, the oxide layer thickness was determined according to the aforementioned method in the magnetic layers positioned at the surface and the center part, respectively, the result was 30 nm at the surface and 27 nm at the center part.

(Volume Resistivity Measurement of Test Piece)

The obtained test piece was measured for volume resistivity at the surface and the center part according to the method below.

An evaluation test piece of 0.2 mm×0.2 mm×0.1 mm was cut out from the surface and the center part, respectively, of the obtained test piece, and a Au film was formed on a pair of opposing faces of each such test piece over their entirety by means of sputtering, to obtain evaluation samples. Each obtained evaluation sample was measured for resistance value by treating the Au films formed on both faces of the sample as electrodes, and applying voltage between the electrodes until an electric field strength of 60 V/cm was achieved, and based on the measured resistance value, the volume resistivity was calculated.

The volume resistivity was 100 MΩ·cm with the test piece on the surface side, and 92 MΩ·cm with the test piece on the center part side.

Comparative Example

The test piece pertaining to the comparative example was obtained in the same manner as in the example, except that the air was used as the heat treatment atmosphere in the second treatment.

When the oxide layer structure in the obtained test piece was confirmed according to the same method in the example, the oxide layer contained Si as well as Fe and Cr, and while Si was contained in the largest quantity at the boundary part with the soft magnetic alloy grain, Cr was most abundant in almost all areas on the interior side thereof, and the content of Cr was the highest overall.

Also, when, with respect to the obtained test piece, the oxide layer thickness was determined according to the same method in the example, in the magnetic layers positioned at the surface and the center part, respectively, the result was 100 nm at the surface and 50 nm at the center part.

Furthermore, when the obtained test piece was measured for volume resistivity at the surface and the center part according to the same method in the example, the result was 2 MΩ·cm with the test piece on the surface side, and 1 MΩ·cm with the test piece on the center part side.

It can be argued, from comparing the example and the comparative example, that a magnetic body will have a thin oxide layer as well as a small difference in layer thickness between its surface and center part, and therefore offer excellent electrical insulating property, when it is constituted by: soft magnetic alloy grains that contain Fe, Si, and at least one of Cr and Al, as constituent elements; and an oxide layer formed around the soft magnetic grains to bond the soft magnetic grains together, and also containing Si as well as at least one of Cr and Al as constituent elements, where the content of Si based on mass is higher than the total content of Cr and Al. Based on the above, it can be argued that the multilayer coil component under the present invention, which uses such magnetic body for magnetic layers, will provide a coil component offering excellent magnetic properties and having a small thickness, because the distance between the internal conductors can be shortened and the element thickness can be reduced as a result.

In this disclosure, "a" may refer to a species or a genus including multiple species, "the invention" or "the present invention" may refer to at least one of the aspects or embodiments explicitly, necessarily, or inherently disclosed herein, and likewise, "the aspect" may refer to at least one of the embodiments or examples explicitly, necessarily, or inherently disclosed herein.

INDUSTRIAL APPLICABILITY

According to the present invention, a multilayer coil component offering excellent magnetic properties and having a small thickness is provided. Accordingly, the present invention is useful in that it will become a coil component for installation in mobile electronic devices and automobiles that must satisfy the needs for both high current flow and thickness reduction. Also, the present invention is useful in that, according to a preferred mode of the present invention, it will turn into a multilayer coil component of low porosity, which means that a multilayer coil component of excellent strength can be provided.

We claim:

1. A multilayer coil component comprising:

multiple magnetic layers stacked in one axis direction;

an internal conductor formed through the magnetic layers; and a pair of external electrodes electrically connected to the internal conductor;

the multilayer coil component characterized in that the magnetic layers are constituted by:

soft magnetic alloy grains containing Fe, Si, and at least one of Cr and Al, as constituent elements; and an oxide layer formed around the soft magnetic alloy grains to bond the soft magnetic alloy grains together, and also containing Si as well as at least one of Cr and Al as constituent elements, wherein soft magnetic alloy grains apart from but adjacent to each other are bonded via a part of the oxide layer continuous from one of the adjacent soft magnetic alloy grains to another of the adjacent soft magnetic alloy grains in a thickness direction of the part of the oxide layer, where a content of Si based on mass is higher than a total content of Cr and Al throughout the part of the oxide layer entirely in the thickness direction thereof.

2. The multilayer coil component according to claim 1, which further has an Fe-rich layer that contains Fe—among Fe, Si, Cr, and Al—in a largest quantity based on mass, on a side of the oxide layer not contacting the soft magnetic alloy grain.

3. The multilayer coil component according to claim 1, wherein a composition of the soft magnetic alloy grain is such that Si is contained by 1 to 10 percent by mass, Cr and Al are contained by 0.2 to 2 percent by mass in total, and Fe and unavoidable impurities account for a remainder.

4. The multilayer coil component according to claim 3, wherein a content of Al in the soft magnetic alloy grain is 0.2 to 1 percent by mass.

5. A circuit board on which the multilayer coil component of claim 1 is mounted.

* * * * *